US005564849A

United States Patent [19]

Greer, Jr.

[11] Patent Number: 5,564,849

[45] Date of Patent: Oct. 15, 1996

[54] CURVED WRITING INSTRUMENT

[76] Inventor: Joseph M. Greer, Jr., c/o Kanaack & Associates 3920 Wyandotte, Kansas City, Mo. 64111

[21] Appl. No.: 581,363

[22] Filed: Dec. 29, 1995

Related U.S. Application Data

[63] Continuation-in-part of Ser. No. 33,586, Jan. 17, 1995, Pat. No. Des. 365,849.

[51] Int. Cl.[6] ..... B43K 7/12; B43K 27/12; B43K 29/12

[52] U.S. Cl. ..... 401/30; 40/334; 401/34; 401/88; 401/195; 401/209

[58] Field of Search ..... 401/30, 34, 88, 401/195, 209; 40/334

[56] References Cited

U.S. PATENT DOCUMENTS

| | | | |
|---|---|---|---|
| D. 344,759 | 3/1994 | Monzyk . | |
| D. 344,978 | 3/1994 | Monzyk . | |
| D. 345,176 | 3/1994 | Monzyk . | |
| 2,005,110 | 6/1935 | Ritzert | 40/334 X |
| 3,079,895 | 3/1963 | Gordon . | |
| 3,093,112 | 6/1963 | Shurcliff . | |
| 3,168,072 | 2/1965 | Nitta . | |
| 3,985,455 | 10/1976 | Wahlberg | 401/30 |
| 3,994,605 | 11/1976 | McKnight . | |
| 4,728,212 | 3/1988 | Spector . | |

FOREIGN PATENT DOCUMENTS

| | | | |
|---|---|---|---|
| 2431377 | 3/1980 | France | 401/88 |
| 4038915 | 6/1991 | Germany | 401/209 |

*Primary Examiner*—Steven A. Bratlie
*Attorney, Agent, or Firm*—Litman, McMahon and Brown, L.L.C.

[57] ABSTRACT

A curved ergonomic pen which facilitates writing on vertical surfaces comprises a housing having a barrel portion and a web portion. The barrel has curved inner and outer edges and substantially flat sides. The web is substantially flat and extends along the curved inner edge of the barrel. A curved channel is formed in the barrel in communication with openings in opposite ends of the barrel. A pair of ink cartridges each comprising an ink tube and a tip secured to one end thereof are retractably secured within the channel such that the respective tips generally extend toward opposite ends of the barrel. The pen tips are selectively extendable and retractable through the associated openings in the opposite ends of the barrel. In one embodiment, a note pocket for receiving relatively small sheets of paper is removably securable within a slot extending into an outer edge of the web. A cover is provided which is removably securable to the housing to cover both ends of the housing and any tips extending therefrom.

20 Claims, 2 Drawing Sheets

Fig. 1.
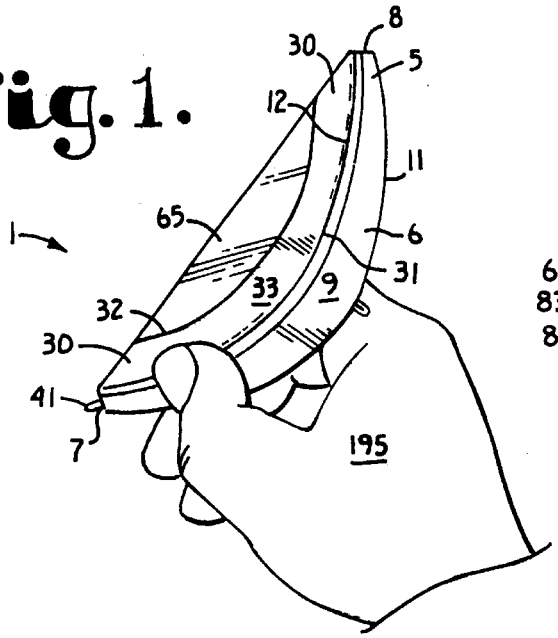
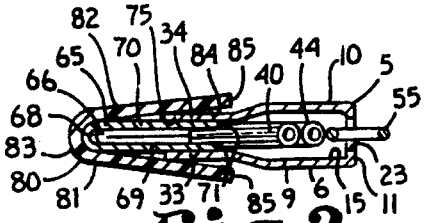
Fig. 3.
Fig. 2.
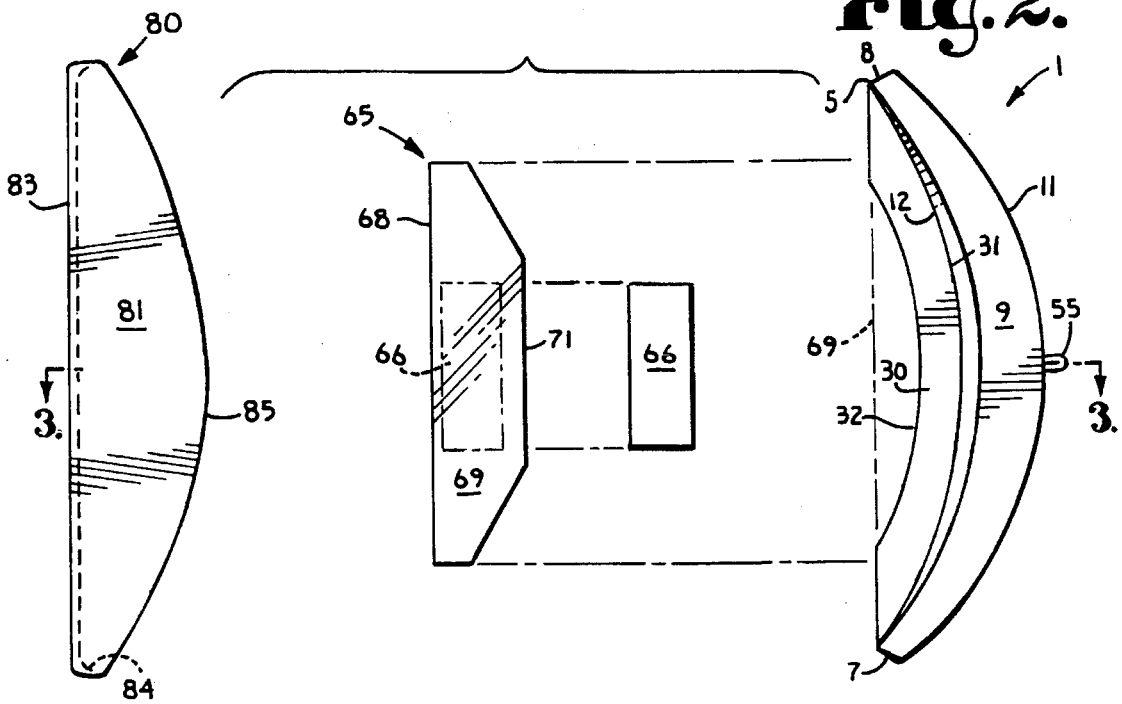

Fig.4.
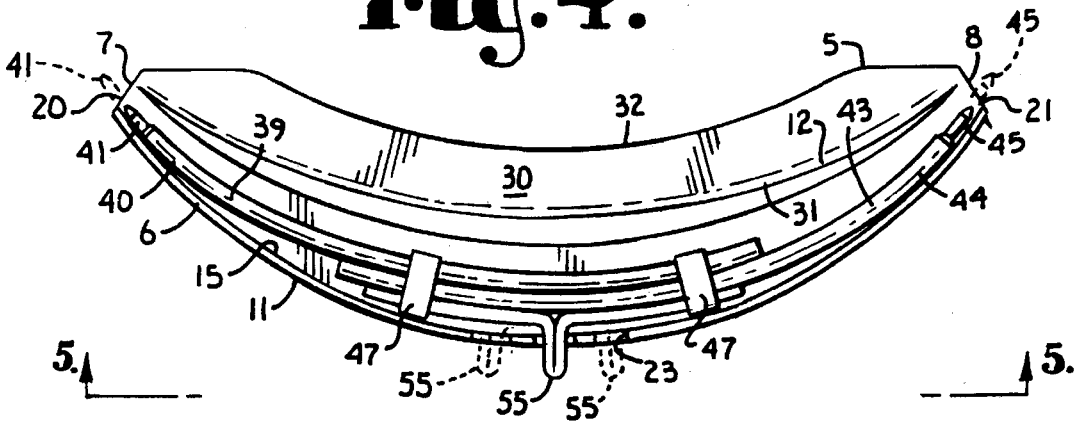
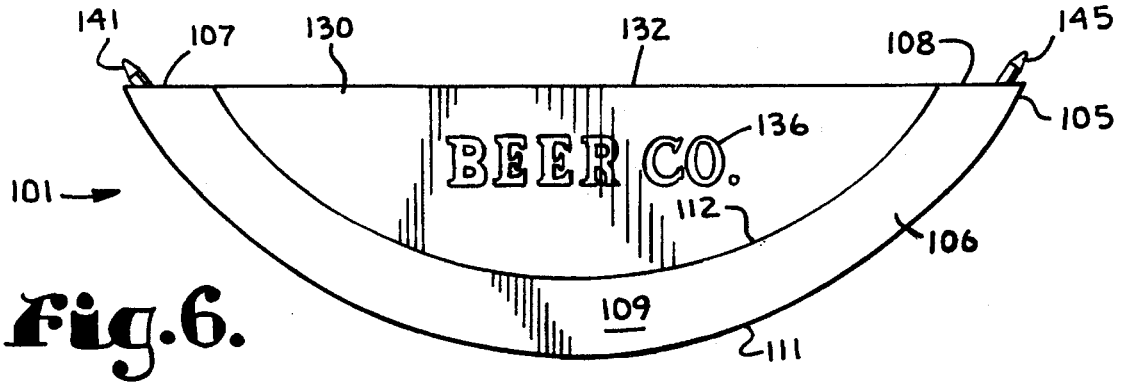
Fig.6.
Fig.5.
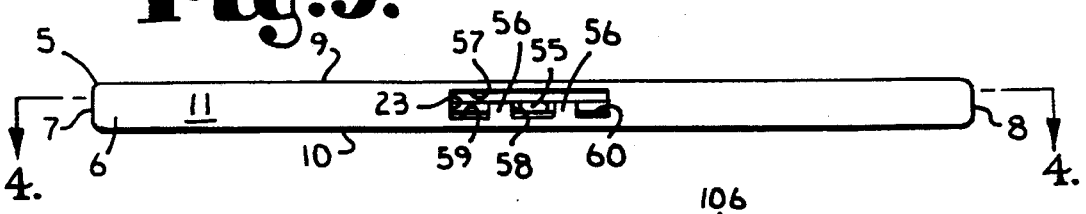
Fig.7.
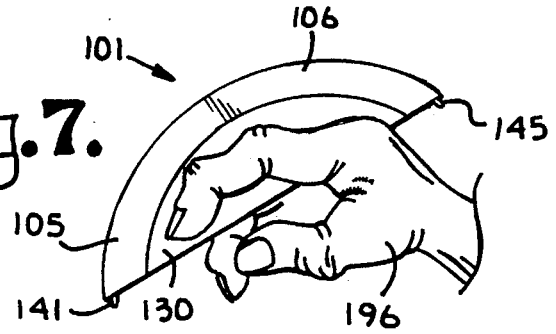

CURVED WRITING INSTRUMENT

CROSS REFERENCE TO RELATED APPLICATIONS

This application is a continuation-in-part of application Ser. No. 29/033,586, entitled WRITING INSTRUMENT, filed Jan. 17, 1995 now Design Patent U.S. Pat. No. 365,849.

BACKGROUND OF THE INVENTION

The present invention relates to an improved ergonomic writing instrument to facilitate writing on horizontal and vertical surfaces.

A ball point pen typically comprises a housing and an ink cartridge connected to a point or tip. Most cartridges are made of plastic tubular material which is generally semi-flexible. The point or tip includes a ball bearing which facilitates the flow of ink from the cartridge to the paper. This ink flow is assisted by gravity and thus a typical ball point pen writes most effectively when held approximately perpendicular to a horizontal writing surface.

Conventional tube shaped writing instruments include long and narrow, tube shaped barrels. These instruments can be difficult to hold and control because they require several fingertips to grip the narrow barrel in a counter-opposing style. This grip results in user discomfort, including callouses and muscle cramps. The elongated tube shape of most pens often results in the stabbing of a person who has placed the pen in a pants pocket or coat pocket and subsequently bends over or turns to one side or the other. Therefore many people avoid carrying pens in their pants or coat pockets.

Even if a person does carry a pen, they are often confronted with a situation where they have a pen but nothing on which to write notes the person wishes to take. Nor does the person have a convenient place to temporarily store the notes after they are taken.

In addition, disposable writing instruments are often given away as promotional items. However, the long and narrow barrel of most writing instruments provides a minimal amount of space to print identifying indicia.

It is clear then, that a need exists for an improved, comfortable writing instrument which can be used to write on both horizontal and vertical surfaces, includes means for carrying note paper therewith and which provides a greater amount of space for printing promotional indicia.

SUMMARY OF THE INVENTION

The present invention is directed to a curved pen to facilitate writing on vertical surfaces. The pen is rigid and comprises a substantially flat, arc shaped housing having one or two ink cartridges secured within a channel formed in the housing. Each ink cartridge comprises a tip secured at one end of an ink tube. The cartridges are secured within the channel such that the pen tips extend through openings on opposite ends of the housing. A relatively thin and flat web extending across a central portion of the arc shaped housing facilitates gripping of the pen and provides relatively large flat surface area on which indicia may be printed. The tips may be retractable in and out of the housing at the opposite ends thereof. In one embodiment, a note pocket for receiving relatively small sheets of paper may be removably secured within a slot extending into an outer edge of the web. A cover is provided which is removably securable to the housing to cover both ends of the housing and any tips extending therefrom.

Flat sides of the housing may be held between the thumb and index finger, while a curved outer edge of the housing rests on the middle finger. Held in this position and near a vertical surface, a distal portion of the curved outer edge of the housing is substantially parallel to the vertical surface. The curvature of the pen allows the ink to flow downward through the ink cartridge and facilitates writing on vertical surfaces. The curved pen can also be held with an outer edge of the web facing the hand; in this position the pen is suited for writing on horizontal surfaces.

OBJECTS AND ADVANTAGES OF THE INVENTION

The principal objects of the present invention are: to provide an improved writing instrument which is ergonomic in design; to provide such a writing instrument to facilitate writing on vertical surfaces, as well as horizontal surfaces; to provide such a writing instrument which alleviates gripping discomfort; to provide such a writing instrument which may be comfortably carried in pockets such as pants pockets or coat pockets; to provide such a writing instrument with a pen point at each end; to provide such a writing instrument which can accommodate more than one ink cartridge; to provide such a writing instrument which provides a pocket for retaining note paper; to provide such a writing instrument which provides relatively large and flat surfaces for printing logos or other promotional indicia thereon; to provide such a writing instrument which is inexpensive to produce; and to provide such a writing instrument which is particularly adapted for its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of an improved curved writing instrument of the present invention having a note pocket secured thereto and held by a persons hand.

FIG. 2 is an exploded and enlarged side view of the improved curved writing instrument of the present invention showing the note pocket and a cover secured thereto.

FIG. 3 is an enlarged cross-sectional view taken along line 3—3 of FIG. 2 with the relative thickness of components exaggerated for clarity.

FIG. 4 is an enlarged cross-sectional view of the improved curved writing instrument of the present invention generally taken along line 4—4 of FIG. 5 without the cover or the note pocket secured thereto and showing the retractability and extendibility of ink cartridges in phantom lines.

FIG. 5 is a view taken along line 5—5 of FIG. 4 looking at a curved outer edge of the curved writing instrument of the present invention.

FIG. 6 is a side view of an alternate embodiment of the improved curved writing instrument of the present invention.

FIG. 7 is a reduced perspective view showing an alternative manner of holding the curved writing instrument as shown in FIG. 6.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIG. 1, there is shown an improved curved writing instrument or pen 1, in accordance with the present invention, ready for use in writing on horizontal or vertical surfaces. The pen 1 comprises a housing 5 including a barrel or barrel portion 6 having a first end 7, a second end 8, a first side 9, a second side 10 a curved outer edge 11 and a curved inner edge 12. A channel 15 is formed within the barrel 6 and generally extends centrally therethrough such that the channel 15 is curved to a similar degree as the curved outer edge 11 and curved inner edge 12. The channel 15 communicates with or opens into a first tip opening 20 formed in the first end 7 of the barrel 6 and a second tip opening 21 formed in the second end 8 of the barrel 6. An adjustment slot 23 is formed in the barrel portion 6 of the housing 5, centrally along the curved outer edge 11 thereof and in communication with the channel 15.

The housing 5 also includes a web or web portion 30 having an inner edge 31, an outer edge 32, a first side 33 and a second side 34. The web 30 extends along at least a portion of the curved inner edge 12 of the barrel 6 and preferably across a substantial portion of the area between the first and second ends 7 and 8 of the barrel 6. The inner edge 31 of the web 30 extends coextensive with the curved inner edge 12 of the barrel 6. The outer edge 32 of the web 30 is preferably curved inward generally conforming to the degree of curvature of the curved outer edge 11 of the barrel 6.

The first and second sides 33 and 34 of the web 30 are preferably substantially flat and particularly well adapted for receiving indicia thereon by printing, etching or other means well known in the art. Similarly, the first and second sides 9 and 10 of the barrel 6 are preferably substantially flat and adapted to receive indicia, although it is foreseeable that the first and second sides may be slightly rounded, rounded, hexagonal or a wide range of shapes. The web 30 is preferably relatively thin and narrower than the barrel 6. The relative thickness of the components of the pen 1 as shown in the cross-sectional view of FIG. 3 are distorted to distinctly show the separate components.

A first ink cartridge 39 comprising a first ink tube or ink reservoir 40 containing ink and a first tip or ink applicator 41 is secured to or connected to a second ink cartridge 43 comprising a second ink tube or ink reservoir 44 containing ink and a second tip or ink applicator 45. The first and second ink cartridges 39 and 43 are of standard design well known in the art wherein the tubes 40 and 44 are made of a semi-flexible plastic and the tips 41 and 45, connected to the tubes 40 and 44, are preferably of the type including a ball point.

The first and second ink cartridges 39 and 43 are secured together in adjacent and opposingly directed alignment such that the first tip 41 generally extends in the opposite direction of the second tip 45 in curved alignment. The first and second ink cartridges 39 and 43 may be secured together by means such as taping the first and second ink tubes 40 and 44 together as generally shown in FIG. 4 with one tube on top of the other. The reference numeral 47 represents the tape securing the tubes 40 and 44 together. It is foreseen that a wide variety of means could be used for securing together the first and second ink tubes 40 and 44 or the first and second ink cartridges 39 and 43 including gluing, integrally forming the tubes together or by lashing the tubes 40 and 44 together.

The first and second ink cartridges 39 and 43 are slidingly positioned or secured within the channel 15 in the barrel 6. The ink cartridges 39 and 43 are preferably sized such that both the first and second tips 41 and 45 are positioned just within the barrel 6 when the first and second ink cartridges 39 and 43 are centrally aligned within the channel 15. A relatively thin bail or tab 55 is secured to the ink cartridges 39 and 43 centrally thereof by means such as taping, as shown in FIG. 4, or other means such as gluing, lashing or the like. The tab 55 extends through the adjustment slot 23 such that at a portion of the tab 55 which may be grasped extends beyond the curved outer edge 11 of the barrel 6.

A pair of projections or dividers 56 extend partially across the adjustment slot 23 and divide the adjustment slot 23 into a main slot 57 and three chambers; a central chamber 58, a first side chamber 59, and a second side chamber 60. The tab 55 is selectively advanceable along the main slot 57 and between and into the three chambers 58, 59, and 60. The tab 55 is secured to the ink cartridges 39 and 43 such that it normally extends into one of the chambers 58, 59 or 60 when aligned therewith.

In a retracted position, as shown in solid lines in FIG. 4, the tab 55 is positioned in and extends through the central chamber 58 and the first and second tips 41 and 45 are positioned within the barrel 6. To advance the cartridges 39 and 43 to a first extended position, wherein the first tip 41 extends through the first tip opening 20 and out of the barrel 6, the tab 55 is pushed or urged out of the central chamber 58 against a rotational biasing force of the ink tubes 40 and 44 and slid along the main slot 57 into alignment with the first side chamber 59. The tab 55 is then pulled into or released and allowed to retract into the first side chamber 59 due to the rotational biasing force exerted by the ink tubes 40 and 44 on the tab 55. Abutment of the tab 55 against the adjacent projection 56 prevents the first tip 41 from retracting back into the barrel 6 during use. When the cartridges 39 and 43 are in the first extended position, the second tip 45 is positioned within the channel 15 of the barrel 6.

Similarly, to advance the cartridges 39 and 43 to a second extended position, wherein the second tip 45 extends through the second tip opening 21 and out of the barrel 6, the tab 55 is pushed or urged into the main slot 57 against the biasing force of the ink tubes 40 and 44 and slid along the main slot 57 into alignment with the second side chamber 60. The tab 55 is then pulled into or released and allowed to retract into the second side chamber 60. Abutment of the tab 55 against the adjacent projection 56 prevents the second tip 45 from retracting back into the barrel 6 during use. When the cartridges 39 and 43 are in the second extended position, the first tip 41 is positioned within the channel 15 of the barrel 6. The retractability and extendibility of the ink cartridges 39 and 43 is generally shown in phantom lines in FIG. 4.

It is foreseen that a wide variety of means could be used for selectively advancing the ink cartridges 39 and 43 between and releasably securing the cartridges 39 and 43 in the retracted position, the first extended position and the second extended position including systems incorporating spring detents or interference fits.

As best shown in FIGS. 1–3, the pen 1 includes a note pocket 65 for use in securing sheets of paper 66 to the pen 1. The pocket 65 is preferably formed from a sheet of relatively rigid and clear plastic which is folded in half along a folded edge 68 to form a first leaf 69 and a second leaf 70. A piece of paper 66, or the like, is removably positionable between first and second leaves 69 and 70. Leading edges 71 of the first and second leaves 69 and 70 are insertable into a note slot 75 extending into the web 30 along a substantial portion of the web outer edge 32 such that at least a portion of both leaves 69 and 70 of the note pocket 65 extend into the note slot 75. The note slot 75 is sufficiently narrow to provide an interference fit of the note pocket 65 within the note slot 75. The note pocket 65 is preferably sized such that a portion of the note pocket 65 remains outside of the note slot 75 when secured therein to provide a surface for grasping to facilitate removal of the note pocket 65.

It is foreseen that the pocket could be used to hold a wide range of items including paper currency or coins, stamps, sewing materials or other relatively narrow items. Further it is foreseen that the pocket could be of a wide range of configurations and securable to the housing by various means such as with a hook and loop type fastener.

The pen also includes a cover 80 which is removably securable to the housing 5 in covering relationship with the first and second ends 7 and 8 of the barrel 6. The cover 80, as shown in FIGS. 2 and 3, generally comprises a first side panel 81 and a second side panel 82 joined together along a cover folded edge 83 and forming a pen housing receiving cavity 84 therebetween. Each side panel 81 and 82 includes an outwardly curved distal end 85 generally conforming to the curvature of the curved inner edge 12 of the barrel 6. The cover is positionable over the housing 5 such that the web 30 and the first and second ends 7 and 8 of the barrel 6, and either tip 41 or 45 extending outside of the barrel 6, are positioned within the pen housing receiving cavity 84. The side panels 81 and 82 are sufficiently spaced apart and sufficiently biasable along the folded edge 83 to provide an interference fit of the cover 80 on the housing 5. It is foreseeable that inner surfaces of the cover 80 could be lined with a resilient material to facilitate removable securement of the cover 80 to the housing 5. It is also foreseeable that other configurations could be developed for covering the first and second ends 7 and 8 of the barrel 6 preferably with a single cover. Outer surfaces of the first and second side panels 81 and 82 of the cover 80 are preferably substantially flat and may also be adapted to receive indicia thereon by printing, engraving or other methods well known in the art.

FIG. 6 shows an alternative embodiment 101 of the pen of the present invention comprising a pen housing 105 having a barrel 106 with a first end 107, a second end 108, a first side 109, a second side (not shown), a curved outer edge 111 and a curved inner edge 112. A substantially flat web 130 extends along the curved inner edge 112 of the barrel 106 between the first and second ends 107 and 108 thereof. An outer edge 132 of the web 130 generally extends straight between the first and second ends 107 and 108 of the barrel 106. The web 130 provides a relatively large flat surface for reception of indicia 136 thereon. A first and second ink cartridge, of which only the tips 141 and 145 are shown, are fixedly secured within the barrel 106 such that the tips 141 and 145 protrude from the barrel 106 and are not retractable.

The housings 5 and 105 are preferably formed from molded plastic but may be formed from a wide range of materials and processes including metal, wood or composites. The housings 5 and 105 may be of one-piece or multi-piece construction.

The web 30 is preferably at least slightly thinner than the barrel 6 which generally must be sufficiently thick to accommodate the ink tubes 40 and 44. However, it is foreseen that the web 30 could be of the same thickness as the barrel 6 or the thickness of the web 30 might gradually reduce from the interface with the barrel 6 such that there is no distinct line of demarcation between the curved inner edge 112 of the barrel and the web 30. In such situations, the area of the housing extending adjacent to and defining the channel 15 is considered the barrel 6 and the curved inner edge 112 of the housing may not be distinct but generally extends proximate the channel 15 on an opposite side thereof from the curved outer edge 111.

It is also foreseen that the first and second ink reservoirs could be integrally formed within the barrel 6 such that a separate tube would not be necessary. It is also foreseeable that the reservoir, which would generally take the place of the channel 15, would not have to be curved. Further, although the preferred embodiment discloses a ball point pen type writing instrument it is foreseen that the housings 5 and 105 could be adapted for use with other type writing instruments including felt tip markers. For felt tip markers, it is foreseen that the ink reservoir would hold the marker fluid and a felt tip would be secured to the barrel such that a portion extends into the reservoir and a portion extends through the respective opening in the barrel and out of the barrel. It is foreseeable that two such reservoirs and tips could be incorporated into the housing and that the tips could be retractable and a cover could be provided for covering both tips.

It is also foreseen that in addition to pen type markers and felt tip type markers, the curved writing instrument could be adapted for use with other marking means such as pencil leads, chalk, crayons, wax pens or paint brushes which could be secureable to the barrel 6 either in a fixed alignment, a removable and replaceable configuration, or a retractable and extendable configuration. The marking means could be adapted for marking a wide range of items or materials such as paper, wood, plastic, stone or glass.

In use, the pen 1 may be held in a persons hand 195, as shown in FIG. 1, when it is desired to write on a vertical surface (not shown). The pen 1 may be positioned such that the thumb and index finger grasp a portion of the barrel 6 and the web 30 with a portion of the curved outer edge 111 of the barrel 6 resting on a side of the middle finger and such that a portion of the housing, including an end of the ink tube 40 or 44 opposite the tip 41 or 45, generally extends above the hand 195 and the tip 41 or 45. To write on horizontal surfaces (not shown) the pen 1 is generally flipped over such that the tips 41 and 45 point downward. Holding the pen 1 along the relatively broad and flat surfaces of the pen housing 5 reduces the stress on the fingers from prolonged grasping. Further the relatively broad and flat surfaces of the pen housing 5 prevents the pen 1 from rotating in the hand during use which is a problem associated with use of round or hexagonal pens or the like.

FIG. 7 shows an alternative way of holding the pen 1 which is particularly useful for people who have a hard time gripping a pen such as arthritis sufferers. The pen 101 can be held by positioning the web 130 between the index and middle fingers of the hand 196.

The shape of the pens 1 and 101 of the present invention provide a pen which may be comfortably placed in a pocket such as a pants pocket and reduces the likelihood of jabbing or stabbing the pants wearer.

It is to be understood that while certain forms of the present invention have been illustrated and described herein, it is not to be limited to the specific forms or arrangement of parts described and shown.

What is claimed and desired to be secured by Letters Patent is as follows:

1. A writing instrument comprising:

a. a housing including:

i. a barrel having a first end, a second end, a curved outer edge and a curved inner edge; and ii. a web having a first side and a second side and extending along at least a portion of said curved inner edge of said barrel; said first and second sides of said web are substantially flat;

b. a first reservoir of ink secured within said barrel; and c. a first ink applicator having a tip and secured to said housing such that said tip extends through a first tip opening in said first end of said barrel.

2. The writing instrument as in claim 1 wherein:

a. a first and a second side of said barrel are substantially flat.

3. The writing instrument as in claim 1 further comprising:

a. retraction means for retracting said first tip into said barrel.

4. The writing instrument as in claim 1 wherein a note slot is formed in said web along an outer edge thereof and said writing instrument further comprises:

a. a note pocket for holding relatively small sheets of paper; at least a portion of said note pocket is removably securable within said note slot.

5. The writing instrument as in claim 1 wherein a second tip opening is formed in a second end of said barrel and said writing instrument further comprising:

a. a second reservoir of ink secured within said barrel; and b. a second ink applicator having a tip and secured to said housing such that said tip of said second ink applicator extends through said second tip opening in said second end of said barrel.

6. The writing instrument as in claim 5 further comprising:

a. a cover removably securable to said writing instrument in covering relationship with said first and second ends of said barrel.

7. The writing instrument as in claim 5 further comprising:

a. retraction means for selectively advancing and releasably securing said first and second tips between a retracted position wherein said first and second tips are positioned within said barrel, a first extended position wherein said first tip extends through said first tip opening and said second tip is positioned within said barrel, and a second extended position wherein said second tip extends through said second tip opening and said first tip is positioned within said barrel.

8. A pen comprising:

a. a housing including:

i. a barrel having a curved outer edge and a curved inner edge; a curved channel is formed within said barrel; said curved channel communicating with a first tip opening formed in a first end of said barrel; and ii. a web having a first side and a second side and extending along at least a portion of said curved inner edge of said barrel; said first and second sides of said web are substantially flat; and b. a first ink cartridge comprising a first ink tube and a first tip connected to one end of said first ink tube; said first ink cartridge secured within said barrel such that said first ink tube is positioned in said curved channel and said first tip extends through said first tip opening.

9. The pen as in claim 8 wherein:

a. a first and a second side of said barrel are substantially flat.

10. The pen as in claim 8 further comprising:

a. retraction means for retracting said first tip into said barrel.

11. The pen as in claim 8 wherein a note slot is formed in said web along an outer edge thereof and said pen further comprises:

a. a note pocket for holding relatively small sheets of paper; at least a portion of said note pocket is removably securable within said note slot edge.

12. The pen as in claim 8 wherein a second tip opening is formed in a second end of said barrel and further comprising:

a. a second ink cartridge comprising a second ink tube and a second tip connected to one end of said second ink tube; said second ink cartridge secured within said barrel such that said second ink tube is positioned in said curved channel and said second tip extends through said second tip opening.

13. The pen as in claim 12 further comprising:

a. a cover removably securable to said housing in covering relationship with said first and second ends of said barrel.

14. The pen as in claim 12 wherein said first and second ink cartridges are connected together and selectively advanceable between a retracted position wherein said first and second tips are positioned within said barrel, a first extended position wherein said first tip extends through said first tip opening and said second tip is positioned within said barrel, and a second extended position wherein said second tip extends through said second tip opening and said first tip is positioned within said barrel.

15. A pen comprising:

a. a housing including:

i. a barrel having a first end, a second end, a curved outer edge and a curved inner edge; a curved channel is formed within said barrel; said curved channel communicating with a first tip opening formed in said first end of said barrel and a second tip opening formed in said second end of said barrel; and ii. a web having a first side and a second side and extending along at least a portion of said curved inner edge of said barrel; said first and second sides of said web are substantially flat;

b. a first ink cartridge comprising a first ink tube and a first tip connected to one end of said first ink tube; said first ink cartridge secured within said barrel such that said first ink tube is positioned in said curved channel and said first tip is extendable through said first tip opening; and c. a second ink cartridge comprising a second ink tube and a second tip connected to one end of said second ink tube; said second ink cartridge secured within said barrel such that said second ink tube is positioned in said curved channel and said second tip is extendable through said second tip opening.

16. The pen as in claim 15 wherein:

a. a first and a second side of said barrel are substantially flat.

17. The pen as in claim 15 wherein a note slot is formed in said web along an outer edge thereof and said pen further comprises:

a. a note pocket for holding relatively small sheets of paper; at least a portion of said note pocket is removably securable within said note slot edge.

18. The pen as in claim 17 further comprising:

a. a cover removably securable to said housing in covering relationship with said first and second ends of said barrel.

19. The pen as in claim 17 wherein said first and second ink cartridges are connected together and said pen further comprises:

a. retraction means for selectively advancing and releasably securing said first and second ink cartridges between a retracted position wherein said first and second tips are positioned within said barrel, a first extended position wherein said first tip extends through said first tip opening and said second tip is positioned within said barrel, and a second extended position wherein said second tip extends through said second tip opening and said first tip is positioned within said barrel.

20. A writing instrument comprising:

a. a housing including:

i. a barrel having a first end, a second end, a curved outer edge and a curved inner edge; and ii. a web having a first side and a second side and extending along at least a portion of said curved inner edge of said barrel; said first and second sides of said web are substantially flat; and b. marking means securable to said barrel relative to said first end for marking items.

* * * * *